US007846518B2

(12) United States Patent
Hahn

(10) Patent No.: US 7,846,518 B2
(45) Date of Patent: Dec. 7, 2010

(54) DUST FREE ABSORBENT PACKAGING MATERIALS

(75) Inventor: Hans-Ulrich Hahn, Neustadt (DE)

(73) Assignee: Honeywell International Inc., Morristown, NJ (US)

( * ) Notice: Subject to any disclaimer, the term of this patent is extended or adjusted under 35 U.S.C. 154(b) by 910 days.

(21) Appl. No.: 11/605,161

(22) Filed: Nov. 28, 2006

(65) Prior Publication Data

US 2007/0151874 A1 Jul. 5, 2007

Related U.S. Application Data

(60) Provisional application No. 60/756,314, filed on Jan. 5, 2006.

(51) Int. Cl.
*B27M 3/00* (2006.01)
*B27N 5/02* (2006.01)

(52) U.S. Cl. ..... 428/35.6; 428/36.4; 428/152; 428/182; 428/532; 428/906; 206/584; 206/594; 206/524.4; 206/521; 206/524.3; 206/524.7

(58) Field of Classification Search ..... 428/36.4, 428/152, 35.6, 182, 532, 906; 206/584, 594, 206/524.4, 521, 524.3, 524.7
See application file for complete search history.

(56) References Cited

U.S. PATENT DOCUMENTS

| | | | | |
|---|---|---|---|---|
| 5,660,904 | A * | 8/1997 | Andersen et al. | 428/36.4 |
| 5,738,921 | A | 4/1998 | Andersen et al. | |
| 5,843,544 | A | 12/1998 | Andersen et al. | |
| 6,841,211 | B1 | 1/2005 | Knoll et al. | 428/34.5 |
| 6,878,199 | B2 | 4/2005 | Bowden et al. | 106/162.5 |
| 2005/0182196 | A1 | 8/2005 | Khemani et al. | |

FOREIGN PATENT DOCUMENTS

| | | | |
|---|---|---|---|
| DE | 3534706 | A * | 4/1987 |
| EP | 0441996 | | 8/1991 |
| EP | 1 327 663 | A1 | 7/2003 |

* cited by examiner

*Primary Examiner*—Michael C Miggins
(74) *Attorney, Agent, or Firm*—Carrie A. Beatus

(57) ABSTRACT

A liquid-absorbing, impact-absorbing packaging container for protecting packaged items such as bottled liquids, while providing absorbency in the event of a liquid spill. The container material is created from a mixture of an inorganic liquid-absorbing agent such as vermiculite, and a cellulosic material such as paper pulp, which mixture is then formed into a container material, for packaging an article such as a glass bottle. The containers and container materials of this invention are substantially free of dust and/or loose particles.

12 Claims, 4 Drawing Sheets

DUST FREE ABSORBENT PACKAGING MATERIALS

CROSS REFERENCE TO RELATED APPLICATIONS

This application claims the benefit of U.S. provisional application Ser. No. 60/756,314 filed on Jan. 5, 2006, which is incorporated herein by reference.

BACKGROUND OF THE INVENTION

1. Field of the Invention

The present invention relates to absorbent materials, and particularly to the formation of dust free absorbent packaging materials.

2. Description of the Related Art

Government regulations often require the use of protective and/or absorbent packaging materials when transporting certain goods, such as hazardous liquids. Particulate absorbent materials, such as vermiculite, are known for use in the packaging of various goods including corrosive and flammable chemicals such as bromine, sodium chlorate, ammonias, and phenol in solid and liquid forms, as well as fragile articles such as glass and china. Vermiculite is an inorganic mineral which is typically ground into lightweight gravel-like particles. These particles are poured around irregularly shaped objects, acting as a baffle against impacts caused by improper handling. The particles are also highly absorbent, thereby safely containing any unwanted leaks or liquid spills. Unfortunately, these tiny absorbent particles are often dusty and dirty, marking up the goods which they surround. In addition, such particles are highly spillable upon unpacking of the goods, often causing a mess.

It would therefore be desirable to formulate a packaging material which provides the protective and absorbent properties of absorbent material particles, while remaining substantially dust free and spill proof. The present invention provides a solution to this problem.

It has now been found that upon forming a mixture of an absorbent material, such as vermiculite particles, with water and a cellulosic material such as paper pulp, this mixture may be formed into an absorbent article which is substantially dust free. Such absorbent articles may be present in the form of a liquid-absorbing, impact-absorbing packaging container for protecting packaged items such as bottled liquids, while providing absorbency in the event of a liquid spill.

SUMMARY OF THE INVENTION

The invention provides a liquid-absorbing, and impact-absorbing packaging container comprising a mixture of an inorganic liquid-absorbing agent and a cellulosic material.

The invention further provides a product which comprises a liquid-absorbing, and impact-absorbing packaging container comprising a mixture of an inorganic liquid-absorbing agent and a cellulosic material, and a liquid containing, breakable bottle supported in the container.

The invention further provides a process for forming a liquid-absorbing, and impact-absorbing packaging container, which comprises:

a) combining an inorganic liquid-absorbing agent, a cellulosic material, and a solvent, to thereby form a mixture; and b) forming the mixture into a container.

The invention still further provides a liquid-absorbing and impact-absorbing packaging container material comprising a mixture of an inorganic liquid-absorbing agent and a cellulosic material, which container material is present in the form of a rollable sheet.

DETAILED DESCRIPTION OF THE INVENTION

Figure 1:
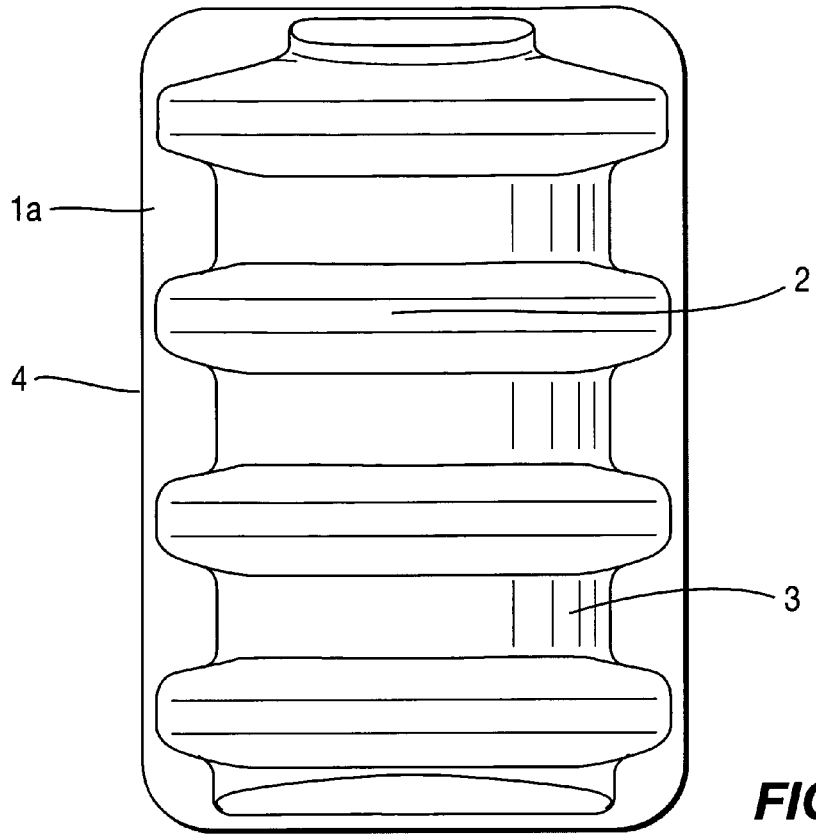
FIG. 1 shows a top view of a bottom container shell of the invention.

The invention provides liquid-absorbing, impact absorbing packaging materials and containers. The shape and materials of the inventive containers enable them to absorb the force of impacts or shocks imparted on them and their contents, thereby protecting against the breaking or damaging of articles packaged therein, such as glass bottles or the like. The inventive containers are also capable of absorbing liquids which may leak or spill from liquid-filled articles packaged therein. A further desirable property of the inventive containers is that they are preferably substantially free of dust and/or loose particles. This prevents the surface of an article packaged therein from becoming dusty, dirty, or otherwise contaminated.

The containers of the invention comprise a container material which comprises a mixture of an inorganic liquid-absorbing agent and a cellulosic material. The inorganic liquid-absorbing agent may comprise any inorganic material which is capable of absorbing liquids. Examples of suitable inorganic liquid-absorbing agents nonexclusively include conventional desiccant materials such as vermiculite, including untreated vermiculite and exfoliated vermiculite, $SiO_2$, Fuller's earth, amorphous alumina silicate gel, dehydrated aluminum-silicate, and the like, and combinations thereof. Preferred absorbent materials exhibit a resistance to certain chemicals. For example, vermiculite and $SiO_2$ exhibit a chemical resistance to sulfuric acid. Thus, vermiculite and $SiO_2$ are highly preferred as liquid-absorbing agents, with vermiculite being most preferred.

The liquid-absorbing agent may be present in any suitable form such as particles, flakes, or the like. Particle size may range from about 0.005 μm to about 1 cm, preferably from about 0.1 μm to about 2 mm, and most preferably from about 1 μm to about 1 mm.

The inorganic liquid-absorbing agent is preferably present in an amount ranging from about 1 to about 80 percent by weight of the overall mixture more preferably from about 10 to about 50 percent by weight of the overall mixture, and most preferably from about 20 to about 40 percent by weight of the overall mixture.

The cellulosic material may comprise any cellulose-based material such as cellulosic paper, cellulosic particles, cellulosic flour, cellulosic pulp, or combinations thereof. Examples of suitable cellulosic materials nonexclusively include various types of wood and wood products, such as wood flour, wood pulp or fibers; paper; tree bark; straw; hay; cotton; hemp; flax; plants and plant components such as leaves, fruits, seeds, pits, flowers, nut shells and the like; grains; rice hull; cornsilk; corn husks; and the like, and combinations thereof. In a preferred embodiment, the cellulosic material comprises wood. The cellulosic material may be present in any suitable form such as particles, fibers, flakes, pulp, chips, paper, shavings, sawdust, flours, cellulose-containing byproducts and the like, and combinations thereof. The cellulosic material may comprise new, reused, or recycled materials, or combinations thereof.

The cellulosic material is preferably present in an amount ranging from about 20 to about 99 percent by weight of the overall mixture more preferably from about 50 to about 90 percent by weight of the overall mixture, and most preferably from about 60 to about 80 percent by weight of the cellulosic composition.

In forming a liquid-absorbing, and impact-absorbing packaging container of this invention, the inorganic liquid-absorbing agent and the cellulosic material are combined together, preferably with a solvent such as water, to thereby form a mixture. In one embodiment the liquid-absorbing agent and the cellulosic material are stirred together to achieve a substantially homogeneous mixture. In certain embodiments, the mixture may further comprise fillers, colorants, binders, and the like.

The mixture is then formed into a packaging container. The container may be formed in a variety of ways. In one embodiment, a container is formed by molding the mixture into a container. Any suitable conventional molding techniques may be used. In another embodiment, a container is formed by extrusion. Any suitable conventional extrusion techniques may be used. The formed containers may be dried by air drying, tunnel drying, baking or the like.

The inventive containers may be formed into any suitable shape and size sufficient for packaging an article such as a glass bottle or the like therein. In one embodiment, the container is designed to fit to the specific shape of an article to be packaged therein. In another embodiment, the container is designed to conform to the shape of an article packaged therein. The containers of this invention may be rigid or flexible, and may be present in the form of a single unit or multiple component container. The containers may also comprise a container material which is corrugated for improved impact resistance.

Another embodiment of this invention provides a liquid-absorbing and impact-absorbing packaging container material comprising a mixture of an inorganic liquid-absorbing agent and a cellulosic material as described above, which container material is present in the form of a rollable sheet. The rollable sheet serves as an impact-absorbing sheet of the inventive container material. The rollable sheet is capable of being rolled around an article such as a bottle, to protect the article from breakage. Such rollable sheets preferably comprise a pattern of impact-absorbing ridges. In one preferred embodiment the rollable sheet comprises a repeating waffle pattern of ridges.

A major advantage of this rollable sheet configuration is that a single sheet design may be used to wrap a variety of bottles or articles having different sizes and shapes. Thus, individual molds of each article shape are not necessary in forming the inventive containers, where rolled sheets are used.

The rollable sheet may be present in the form a container or other packaging material. In fact, when rolled around an article such as a bottle, the rollable sheet may be considered a container. A container which comprises a rollable sheet may or may not comprise end caps or the like, to close off any open ends of the rolled sheet container, to contain possible liquid spillage.

Figure 2:
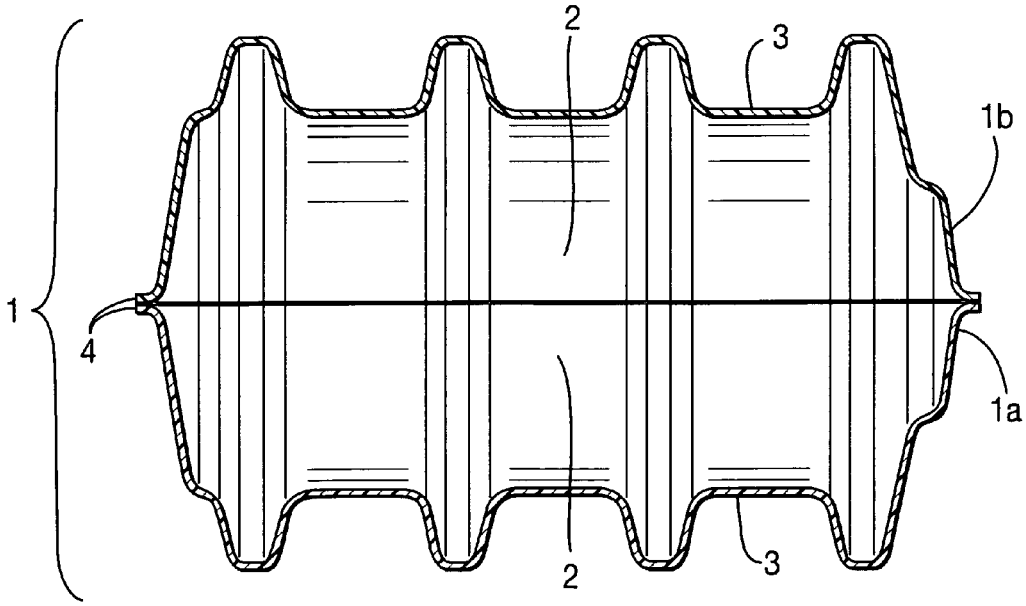
FIG. 2 shows a side view of a container of the invention, having top and bottom shells.
Figure 3:
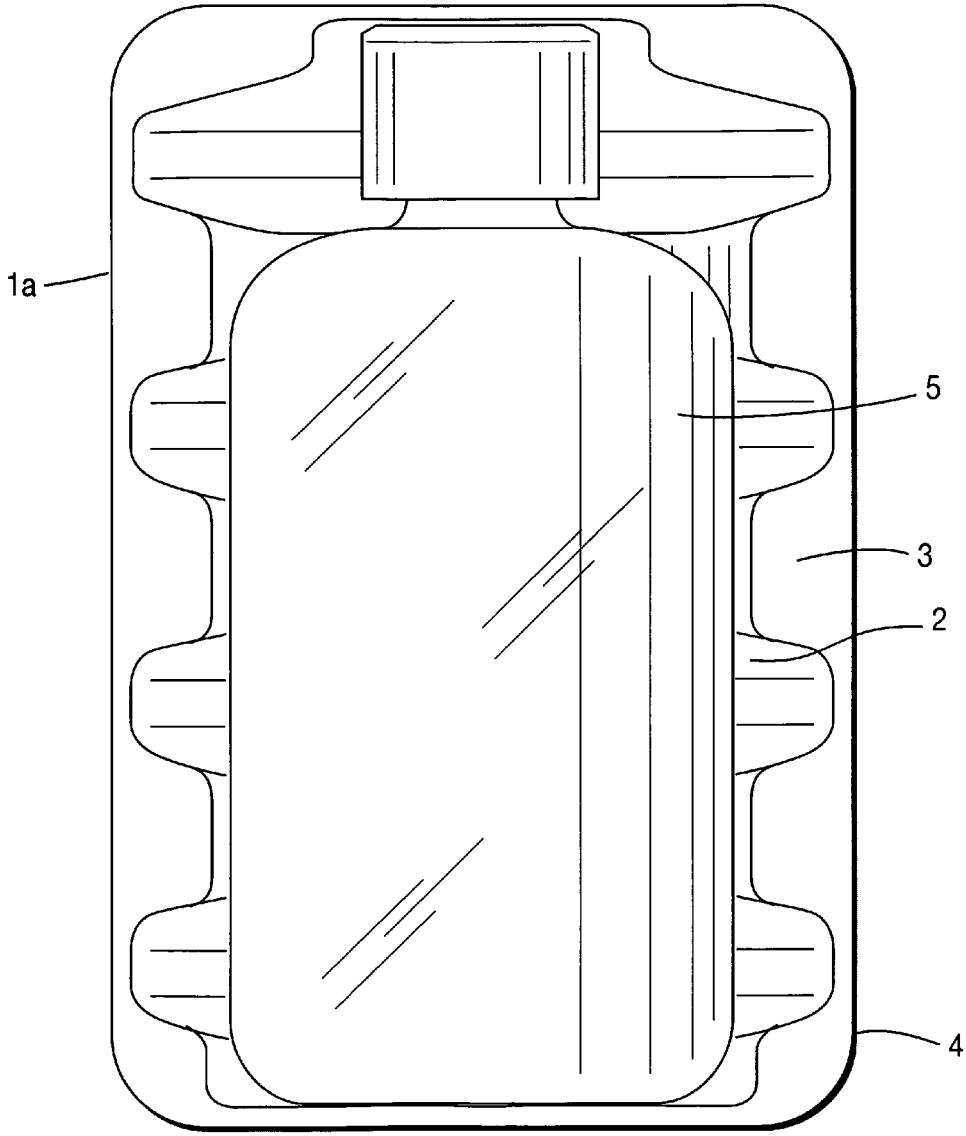
FIG. 3 shows a top view of a bottom container shell of the invention, holding a glass bottle therein.

A multiple component container of the invention is shown in FIGS. 1-6. In particular, FIG. 2 shows an embodiment of the invention wherein a container 1 of the invention comprises a bottom shell 1*a* and a top shell 1*b* which are each shaped to define an internal cavity 2. The shells 1*a*, 1*b* may be the same or different. As shown in FIG. 2, the shells 1*a*, 1*b* of the container 1 are designed to be placed together, in order to protectively house an article to be packaged therein. Preferably, an article is to be placed within the container 1 such that half of the article is held within the cavity 2 of the bottom shell 1*a*, and half of the article is held within the cavity 2 of the top shell 1*b*. FIG. 3 illustrates a bottom shell 1*b* which holds a bottom half of an article 5 therein. A top shell 1*a* (not shown in FIG. 3) is to be placed together with the bottom shell 1*b*, to form a container 1 which securely holds the article 5 therein.

Either or both of the shells 1*a*, 1*b* of the container 1 may further comprise internal ridges 3 for improved impact and/or shock absorption. Such ridges 3 serve to protect an article within the container from damage such as breaking caused by mishandling or the like. Either or both of the shells 1*a*, 1*b* may further comprise a lip 4, to provide a secure attachment between the bottom shell 1*a* and the top shell 1*b* of the container 1. The lip 4 is preferably present around a perimeter of either or both shells 1*a*, 1*b*. If present, the lip 4 may comprise an attachment device such as a clip or snap or the like for securing the shells 1*a*, 1*b* together.

Figure 4:
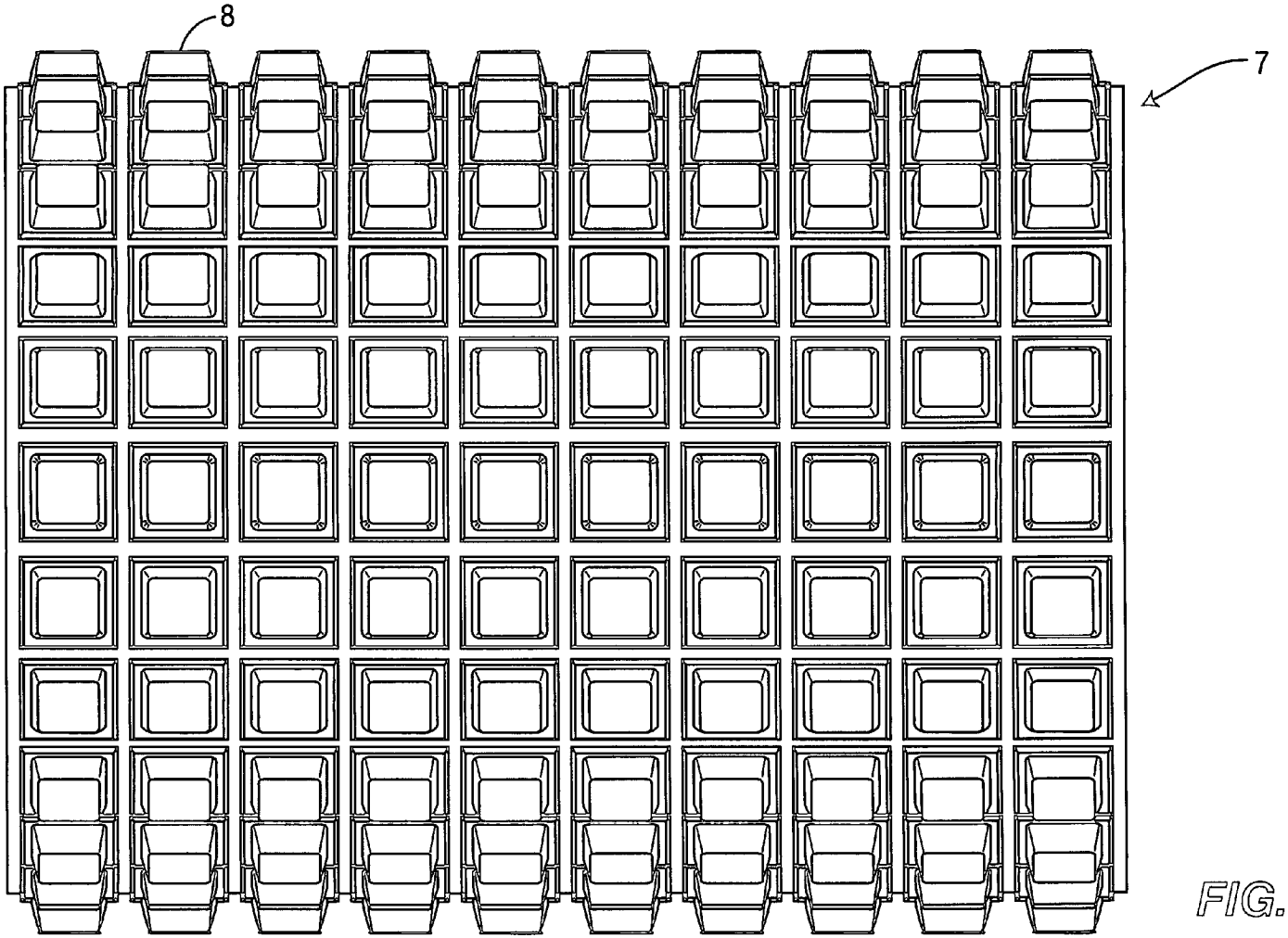
FIG. 4 shows a side perspective view of a container material in the form of a rollable sheet.
Figure 5:
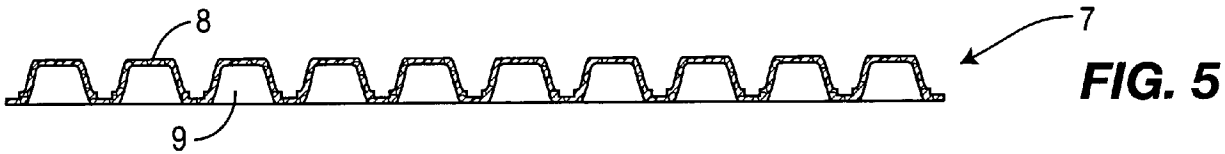
FIG. 5 shows a side cut-away view of a container material in the form of a rollable sheet.
Figure 6:
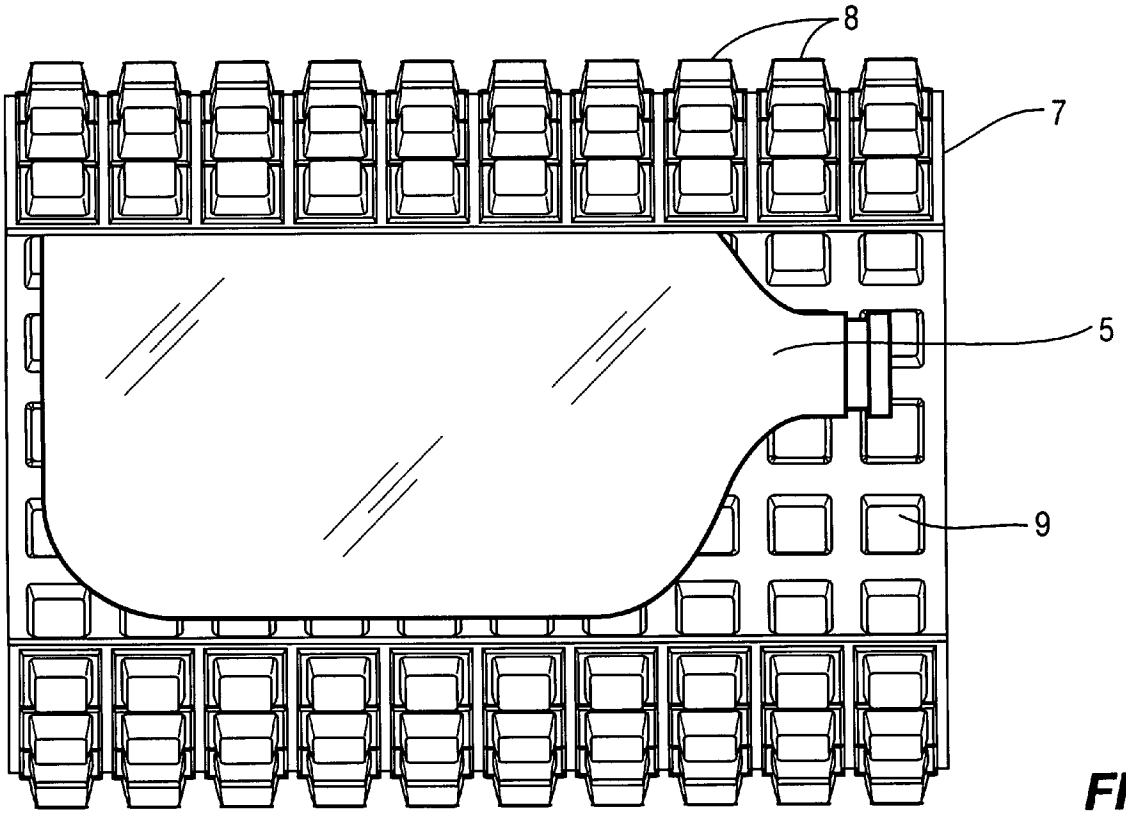
FIG. 6 shows a front view of a rollable sheet of container material wrapped around a glass bottle.

FIGS. 4-6 show an embodiment wherein the container comprises a rollable sheet 7 of the inventive liquid-absorbing container material. FIG. 4 shows a rollable sheet 7 having a repeating waffle pattern of ridges 8 and cavities 9. FIG. 5 shows a side cut-away view of a rollable sheet 7 having an array of concavities in a repeating waffle pattern. The rollable sheet 7 is designed to be capable of being wrapped around a container, such as a glass bottle or the like. FIG. 6 shows an embodiment wherein a rollable sheet 7 of the invention is wrapped around an article 5 such as a glass bottle.

The liquid-absorbing, and impact-absorbing packaging containers of this invention may be used in a variety of applications. One embodiment of the invention relates to a packaging article, such as a shipping box or the like, which comprises a liquid-absorbing, impact absorbing packaging container of this invention. Such a packaging article may comprise multiple containers of the invention.

Another embodiment of this invention relates to a product comprising a liquid-absorbing, impact absorbing packaging container, and a liquid-containing breakable bottle supported in the container. Such products may be part of a commercial shipment or the like.

The following non-limiting examples serve to illustrate the invention. It will be appreciated that variations in proportions and alternatives in elements of the components of the invention will be apparent to those skilled in the art and are within the scope of the present invention.

EXAMPLE 1

100 g of 1 μm vermiculite particles are combined with 200 g of wood pulp and 1 liter of water. These components are stirred together to form a substantially homogeneous mixture. The mixture is then injection molded into a container shape, and dried in a drying tunnel at 200° C. for 12-15 minutes.

EXAMPLE 2

100 g of 2 μm $SiO_2$ particles are combined with 200 g of wood flour and 1 liter of water. These components are stirred together to form a substantially homogeneous mixture. The mixture is then injection molded into a container shape, and dried in a drying tunnel at 200° C. for 12-15 minutes.

While the present invention has been particularly shown and described with reference to preferred embodiments, it will be readily appreciated by those of ordinary skill in the art that various changes and modifications may be made without departing from the spirit and scope of the invention. It is intended that the claims be interpreted to cover the disclosed embodiment, those alternatives which have been discussed above and all equivalents thereto.

What is claimed is:

1. A liquid-absorbing, and impact-absorbing packaging container consisting of a mixture of an inorganic liquid-absorbing agent selected from the group consisting of vermiculite, $SiO_2$, amorphous alumina silicate gel, dehydrated aluminum-silicate, and combinations thereof; and a cellulosic material selected from the group consisting of cellulosic paper, cellulosic particles, cellulosic flour, cellulosic pulp, and combinations thereof; said container being substantially free of dust or loose particles.

2. The container of claim 1 wherein the liquid-absorbing agent is present in the mixture in an amount of from about 10% by wt. to about 50% by wt. of the mixture.

3. The container of claim 1 wherein the liquid-absorbing agent comprises vermiculite.

4. The container of claim 1 wherein the liquid-absorbing agent is present in the form of particles.

5. The container of claim 1 which has been formed by molding the mixture into a container.

6. A liquid-absorbing and impact-absorbing packaging container material consisting of a mixture of an inorganic liquid-absorbing agent selected from the group consisting of vermiculite, $SiO_2$, amorphous alumina silicate gel, dehydrated aluminum-silicate, and combinations thereof; and a cellulosic material selected from the group consisting of cellulosic paper, cellulosic particles, cellulosic flour, cellulosic pulp, and combinations thereof; said material being substantially free of dust or loose particles and which is in the form of a rollable sheet.

7. The container material of claim 6 which is in the form of a rollable sheet having an array of concavities.

8. A container comprising a rollable sheet the container material of claim 6.

9. A packaging article comprising the container of claim 1.

10. The container material of claim 6 wherein the rollable sheet comprises a pattern of impact-absorbing ridges.

11. A packaging article comprising the container material of claim 10.

12. A product which comprises a liquid-absorbing, and impact-absorbing packaging container consisting of a mixture of an inorganic liquid-absorbing agent selected from the group consisting of vermiculite, $SiO_2$, amorphous alumina silicate gel, dehydrated aluminum-silicate, and combinations thereof; and a cellulosic material selected from the group consisting of cellulosic paper, cellulosic particles, cellulosic flour, cellulosic pulp, and combinations thereof; and a liquid containing, breakable bottle supported in the container.

* * * * *